US011646511B1

(12) United States Patent
Wu

(10) Patent No.: US 11,646,511 B1
(45) Date of Patent: May 9, 2023

(54) FEEDER TERMINAL BLOCK

(71) Applicants: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

( * ) Notice: Subject to any disclaimer, the term of this patent is extended or adjusted under 35 U.S.C. 154(b) by 0 days.

(21) Appl. No.: 17/671,133

(22) Filed: Feb. 14, 2022

(30) Foreign Application Priority Data

Jan. 6, 2022 (CN) ..... 202210009686.5

(51) Int. Cl.
*H01R 9/24* (2006.01)
*H01R 4/48* (2006.01)

(52) U.S. Cl.
CPC ..... *H01R 9/2416* (2013.01); *H01R 4/4836* (2013.01); *H01R 4/4845* (2013.01)

(58) Field of Classification Search
CPC .. H01R 9/2416; H01R 9/2466; H01R 4/4836; H01R 4/4845; H01R 4/4809; H01R 4/4818; H01R 12/515
See application file for complete search history.

(56) References Cited

U.S. PATENT DOCUMENTS

| | | | | |
|---|---|---|---|---|
| 9,466,911 | B1 * | 10/2016 | Wu | H01R 13/514 |
| 10,553,978 | B2 * | 2/2020 | Juelich | H01R 4/4836 |
| 10,770,809 | B1 * | 9/2020 | Wu | H01R 4/4836 |
| 10,784,056 | B2 * | 9/2020 | Xiao | H01R 12/55 |
| 11,588,256 | B2 * | 2/2023 | Latorre | H01R 13/62933 |

* cited by examiner

*Primary Examiner* — Vanessa Girardi
(74) *Attorney, Agent, or Firm* — Chun-Ming Shih; HDLS IPR Services

(57) ABSTRACT

A terminal block includes an insulative case, a supply-side conductive plate and a wire connecting module. The insulative case has two wire holes. The supply-side conductive plate is disposed in the insulative case. The wire connecting module is mounted on the supply-side conductive plate and includes a feed-side conductive plate, two insulative supports and two flexible clamping sheets. The feed-side conductive plate is electrically connected to the supply-side conductive plate and includes a first side wall and a second side wall opposite to each other. Each insulative support is arranged on the feed-side conductive plate. Each insulative support and the second side wall jointly form a clamping space. Each flexible clamping sheet is separately disposed on each insulative support. One end of each flexible clamping sheet is flexibly connected with the first side wall, and another end of each flexible clamping sheet is located in the clamping space.

10 Claims, 8 Drawing Sheets

FEEDER TERMINAL BLOCK

BACKGROUND

Technical Field

The disclosure relates to a terminal block, particularly to a feeder terminal block which is modularized and easy to be assembled.

Description of Related Art

With the development of technological industry, terminal blocks are widely applied in various fields such as automatic control, communication equipment and power equipment so as to allow workers to implement rapid wiring for connections between multiple sets of power wires, control wires and data transmission wires, and allow workers to change product types in the production more frequently for freely adjust manual or automatic production and reasonably accomplish the effect of highly efficient production in a small amount and multiple specifications.

However, all related-art terminal blocks have various specifications, so the manufacturers need mass production and large inventory for those terminal blocks with different wire holes. This causes considerable pressure of manufacturing costs and warehousing costs. In addition, with the market demands of high efficiency and high performance in recent years, when the number of the wire holes becomes more, the internal structure becomes more complicated to hinder assembling.

In view of this, the inventors have devoted themselves to the above-mentioned prior art, researched intensively and cooperated with the application of science to try to solve the above-mentioned problems. Finally, the invention which is reasonable and effective to overcome the above drawbacks is provided.

SUMMARY

An object of the disclosure is to provide a feeder terminal block, which is modularized and easy to be assembled, and facilitates increasing or decreasing the number of wires to be inserted.

To accomplish the above object, the disclosure provides a feeder terminal block for multiple wires to be inserted, the feeder terminal block includes an insulative case, a supply conductive plate and a wire connecting module. The insulative case has a chamber and two wire holes communicating with the chamber. The supply-side conductive plate is disposed in the chamber. The wire connecting module is mounted on the conductive plate and includes a feed-side conductive plate, two insulative supports and two flexible clamping sheets. The feed-side conductive plate is electrically connected to the supply-side conductive plate and includes a first side wall and a second side wall opposite to each other. Each insulative support is arranged parallelly on the feed-side conductive plate. Each insulative support and the second side wall separately jointly form a clamping space corresponding to each wire hole. Each flexible clamping sheet is disposed on each insulative support. One end of each flexible clamping sheet is flexibly connected with the first side wall. Another end of each flexible clamping sheet is located in each clamping space and operatably clamps or releases each wire.

The disclosure further has the following functions. By each riveting hole being passed by and fixedly riveted with each riveting bar, the feed-side conductive plate may be fixed on the supply-side conductive plate to form an electric connection. By the slots of the first side wall and the second side wall, each block of each longitudinal side plate may be embedded to fix each insulative support on the feed-side conductive plate. The protrusion in each slot may be interferentially fixed with the block to enhance the fixing effect. By the connecting bar and the connecting hole on a left side and a right side of the transverse side plate, the insulative supports may be connected in series. The multiple hooks of the second side wall may be engaged with each pressing section to axially limit each pressing section. Each release slider formed on a side of each wire hole may press each pressing section to control the communication between each wire hole and each clamping space.

DETAILED DESCRIPTION

Figure 1:
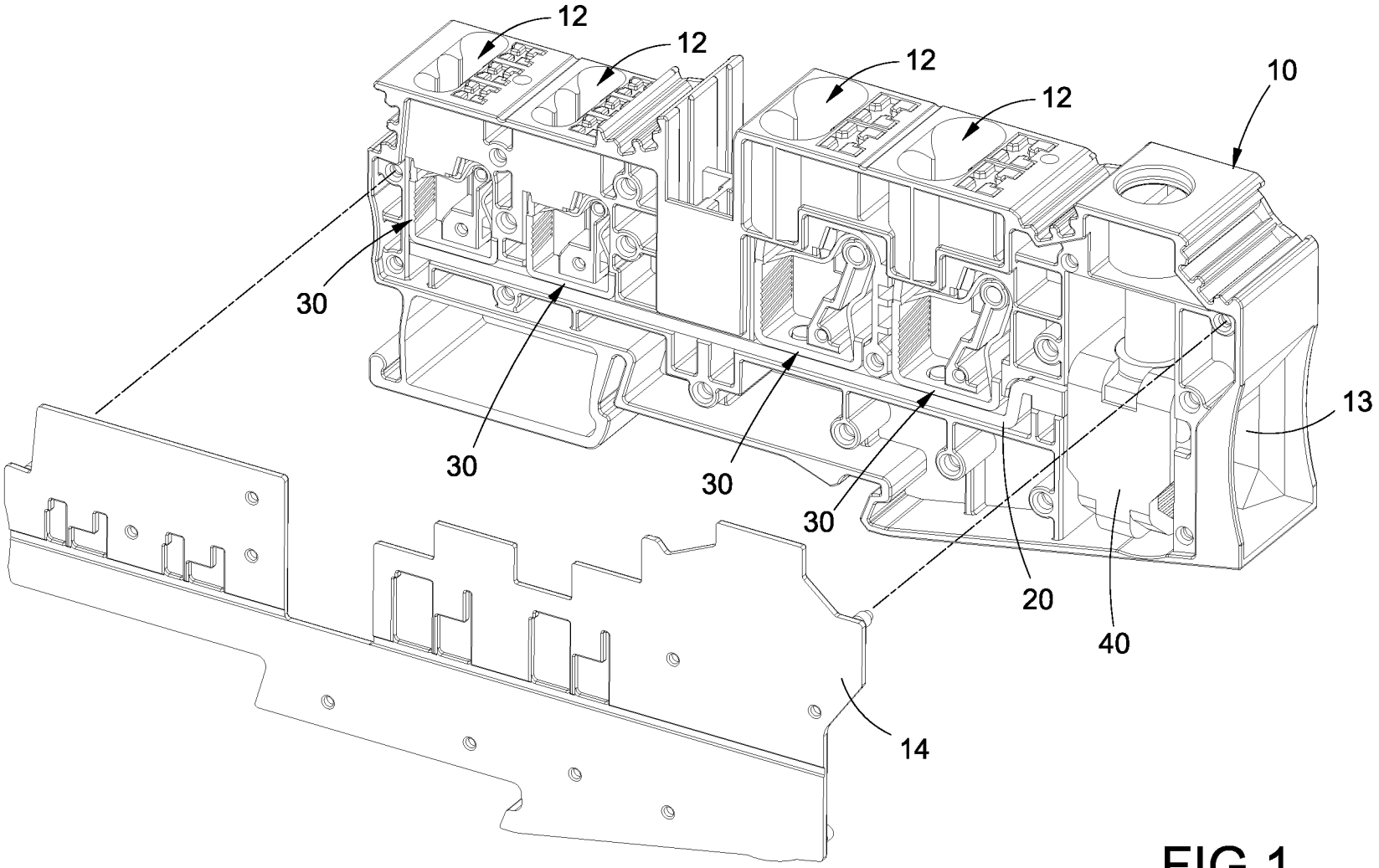
FIG. 1 is an exploded view of the insulative case and the side plate of the disclosure.
Figure 2:
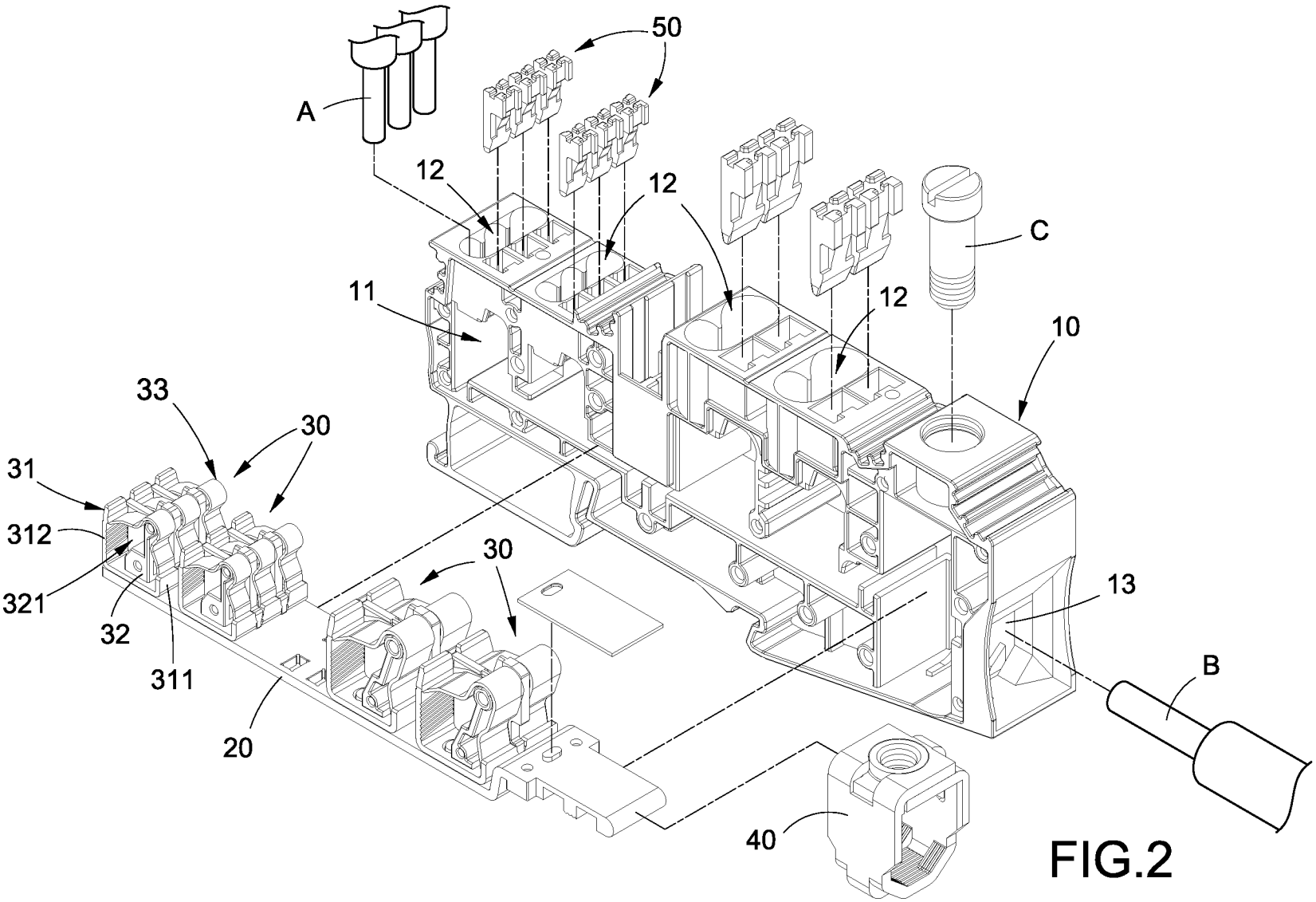
FIG. 2 is an explode view of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

The disclosure provides a feeder terminal block for multiple wires A to be inserted. Please refer to FIGS. 1-7. The feeder terminal block includes an insulative case 10, a supply-side conductive plate 20 and at least one wire connecting module 30.

The insulative case 10 is, but not limited to, integrally formed (or formed in one piece) by plastic injection molding. For example, the insulative case 10 may also be made of other insulative materials. The insulative case 10 has a chamber 11, at least two wire holes 12 communicating with the chamber 11, and a power supply wire hole 13. Each wire A is inserted to reach in the chamber 11 through each wire hole 12. In the embodiment, the wire connection structure associating with the power supply wire hole 13 is of a bolt type, i.e., a power supply wire B is fastened in a conductive box 40 by a bolt C, but not limited to this, for example, the wire connection structure of the power supply wire hole 13 may also be of an elastic sheet type.

In the embodiment, the supply-side conductive plate 20 is a strip-shaped metal plate with the materials of desirable conductivity, such as, but not limited to, silver, copper, gold, aluminum, steel, or an alloy thereof, or any plate with good conductivity is available. The supply-side conductive plate 20 is disposed in the chamber 11. In detail, the supply-side conductive plate 20 is disposed on the bottom of the chamber 11 and contact the conductive box 40 in the power supply wire hole 13 to form an electric connection so as to make the power supply wire B be electrically connected with the supply-side conductive plate 20.

Figure 3:
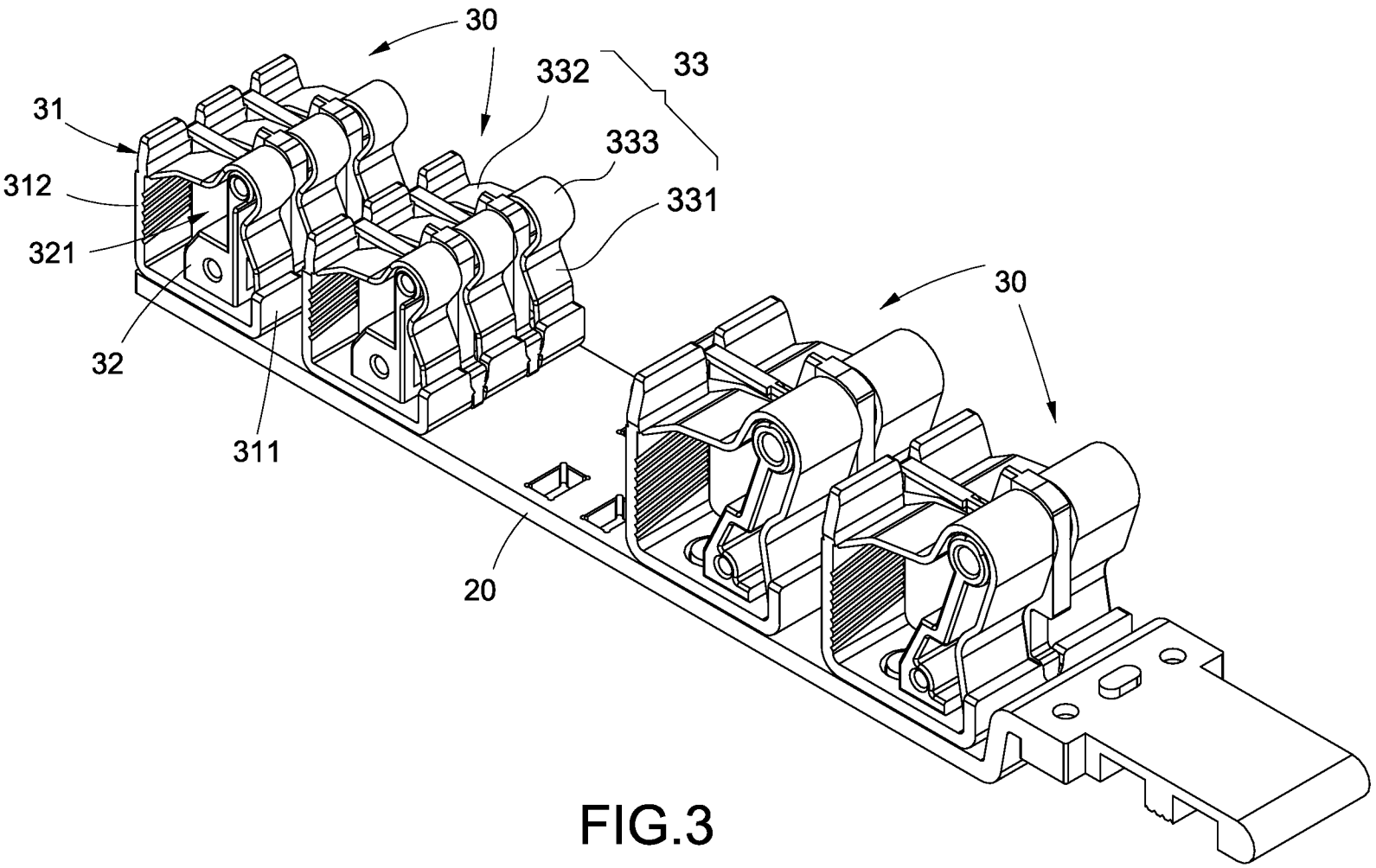
FIG. 3 is a perspective view of the supply-side conductive plate and the wire connecting module of the disclosure.
Figure 4:
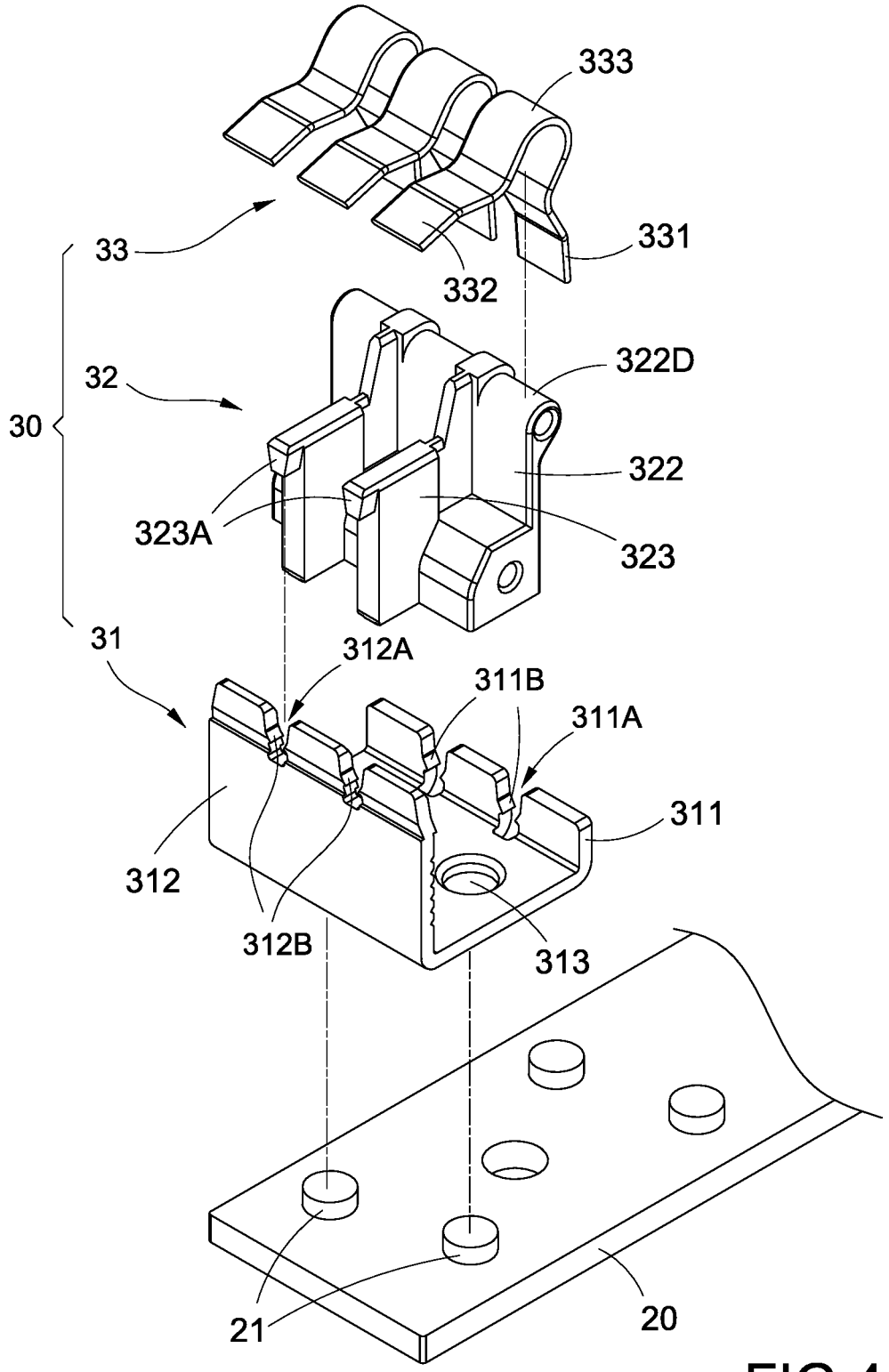
FIG. 4 is a partially exploded view of FIG. 3.
Figure 5:
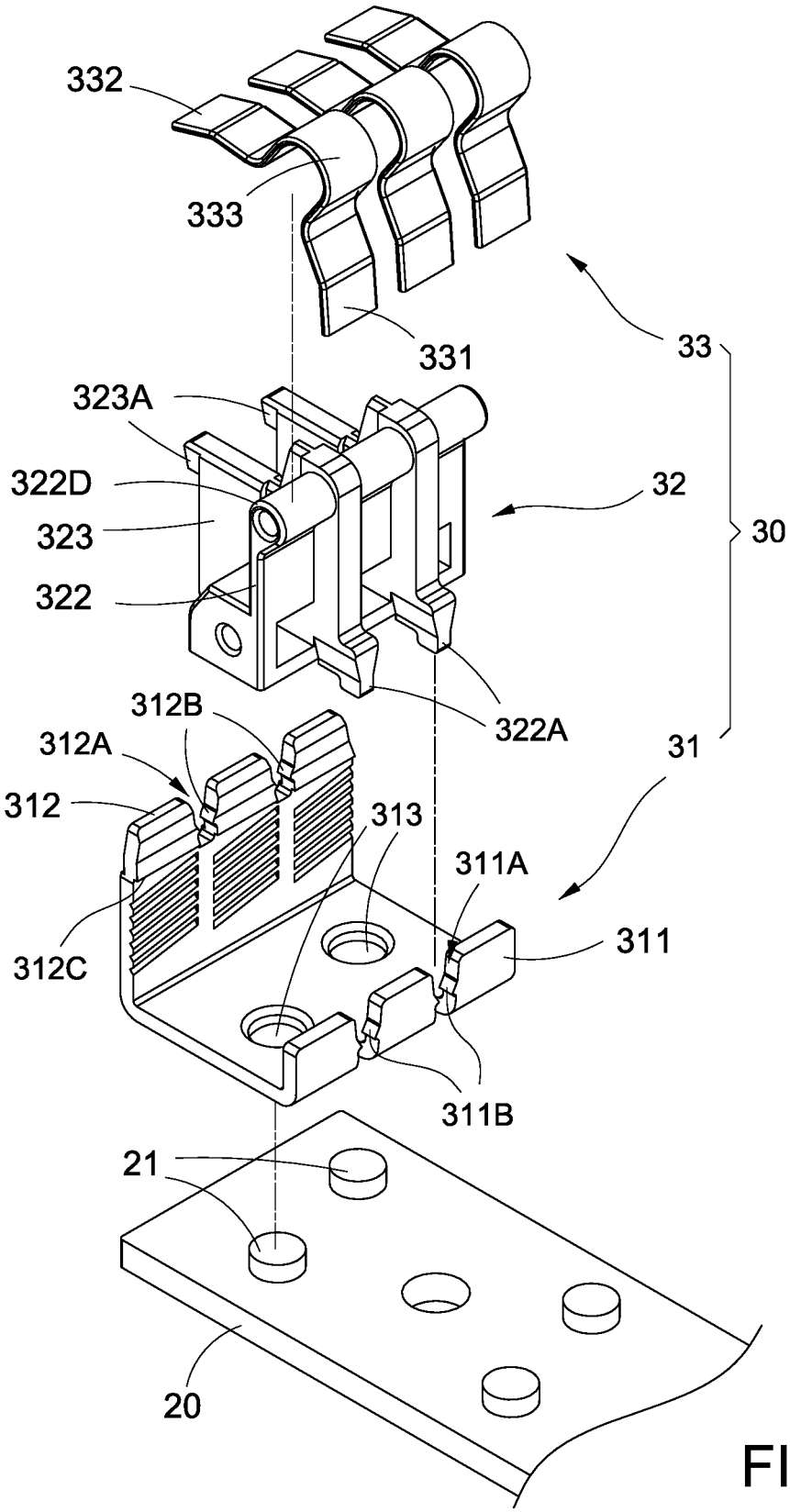
FIG. 5 is another exploded view of FIG. 4 from another point of view.
Figure 6:
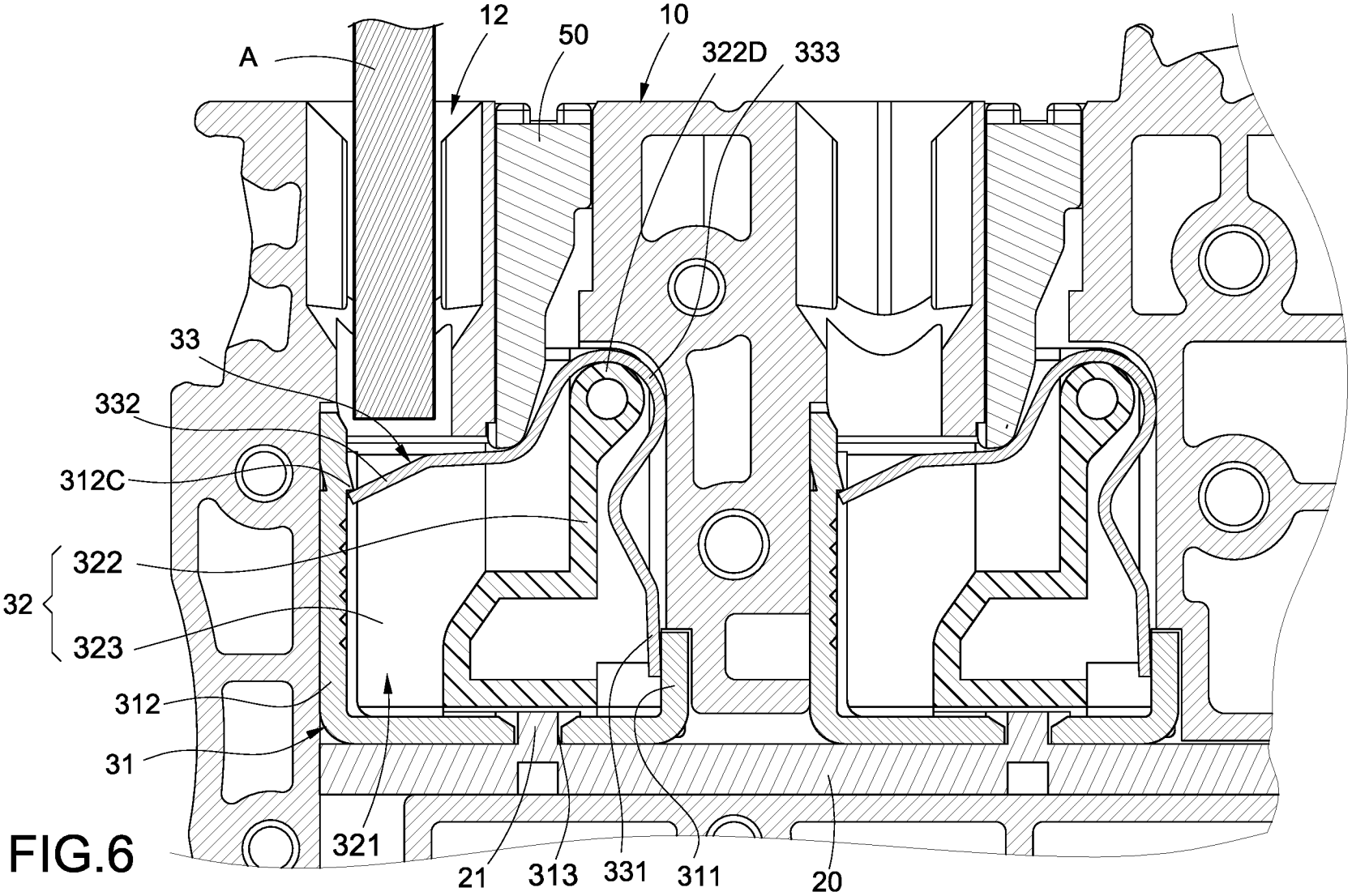
FIG. 6 is a cross-sectional view of a using status of the disclosure.
Figure 7:
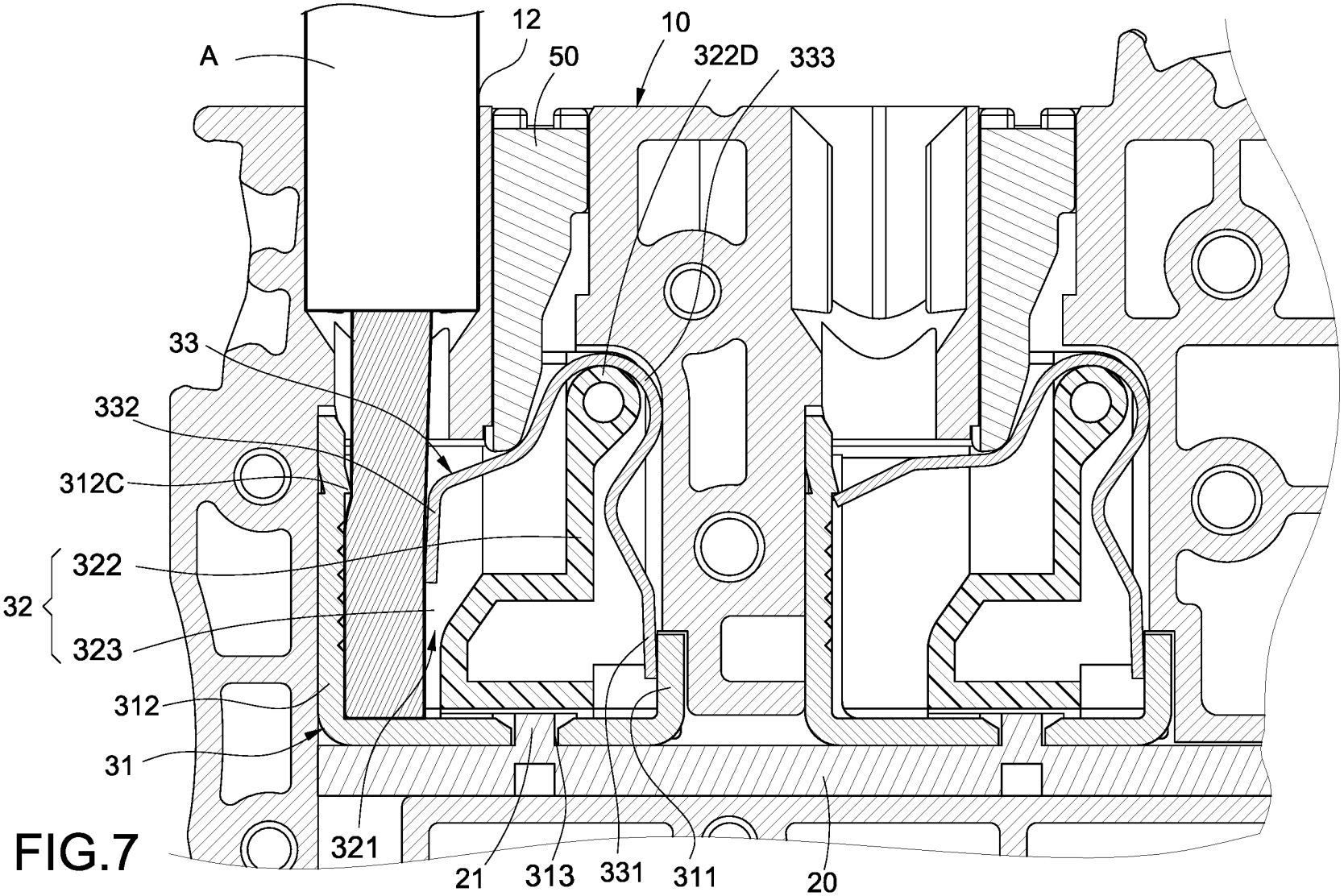
FIG. 7 is a cross-sectional view of another using status of the disclosure.

Please refer to FIGS. 3-5. The wire connecting module 30 is mounted on the supply-side conductive plate 20 and includes a feed-side conductive plate 31, at least two insulative supports 32 and at least two flexible clamping sheets 33. In the embodiment, the wire connecting modules 30 are four in number and longitudinally arranged along the supply-side conductive plate 20, but not limited to this, for example, the wire connecting modules 30 may also be two, three or more than five in number, designers may adjust the number of the wire connecting modules 30 according to different requirements. Also, in the embodiment, the insulative supports 32 and the flexible clamping sheets 33 in each wire connecting module 30 are, but not limited to, three in number, for example, the insulative supports 32 and the flexible clamping sheets 33 in each wire connecting module 30 may also be two or more than four in number, or the insulative supports 32 and the flexible clamping sheets 33 in different wire connecting modules 30 are different in number, it depends on a designer's requirements to correspondingly adjust. It is noted that the feed-side conductive plate 31, each insulative support 32 and each flexible clamping sheet 33 of the wire connecting module 30 shown in the figures are merely exemplified for understanding, so the size and amount of each component do not constitute a limitation to the disclosure.

The feed-side conductive plate 31 is a metal plate with the materials of desirable conductivity, such as, but not limited to, silver, copper, gold, aluminum, steel, or an alloy thereof, or any plate with good conductivity is available. The feed-side conductive plate 31 is stacked on the supply-side conductive plate 20 to form an electric connection therebetween and includes a first side wall 311 and a second side wall 312 opposite to each other. In the embodiment, the supply-side conductive plate 20 is protruded with multiple riveting bars 21. The feed-side conductive plate 31 is formed with multiple riveting holes 313 corresponding to each riveting bar 21. Each riveting hole 313 is passed by and fixedly riveted with each riveting bar 21 to fix the feed-side conductive plate 31 on the supply-side conductive plate 20 to form an electric connection, but not limited to this, any fixture which may fix the both and form an electric connection is applicable.

The insulative support 32 is, but not limited to, integrally formed (or formed in one piece) by plastic injection molding. For example, the insulative support 32 may also be made of other insulative materials. Each insulative support 32 is arranged on the feed-side conductive plate 31. Each insulative support 32 and the second side wall 312 separately jointly form a clamping space 321 corresponding to each wire hole 12. In detail, the insulative support 32 is a substantially L-shaped plate and includes a transverse side plate 322 and a longitudinal side plate 323. The transverse side plate 322, the longitudinal side plate 323 and the second side wall 312 jointly surround the clamping space 321. In the embodiment, each of the first side wall 311 and the second side wall 312 is formed with multiple slots 311A, 312A corresponding to each insulative support 32. Each of a front side and a rear side of each longitudinal side plate 323 is provided with a block 322A, 323A corresponding to each slot 311A, 312A. Each block 322A, 323A is separately embedded in corresponding one of the slots 311A, 312A to fix each insulative support 32 on the feed-side conductive plate 31. In some embodiments, the inside of each slot 311A, 312A may be further formed with at least one protrusion 311B, 312B. The fixing effect between each insulative support 32 and the feed-side conductive plate 31 may be further strengthened by the interferential fixture between the protrusions 311B, 312B and the blocks 322A, 323A.

Figure 8:
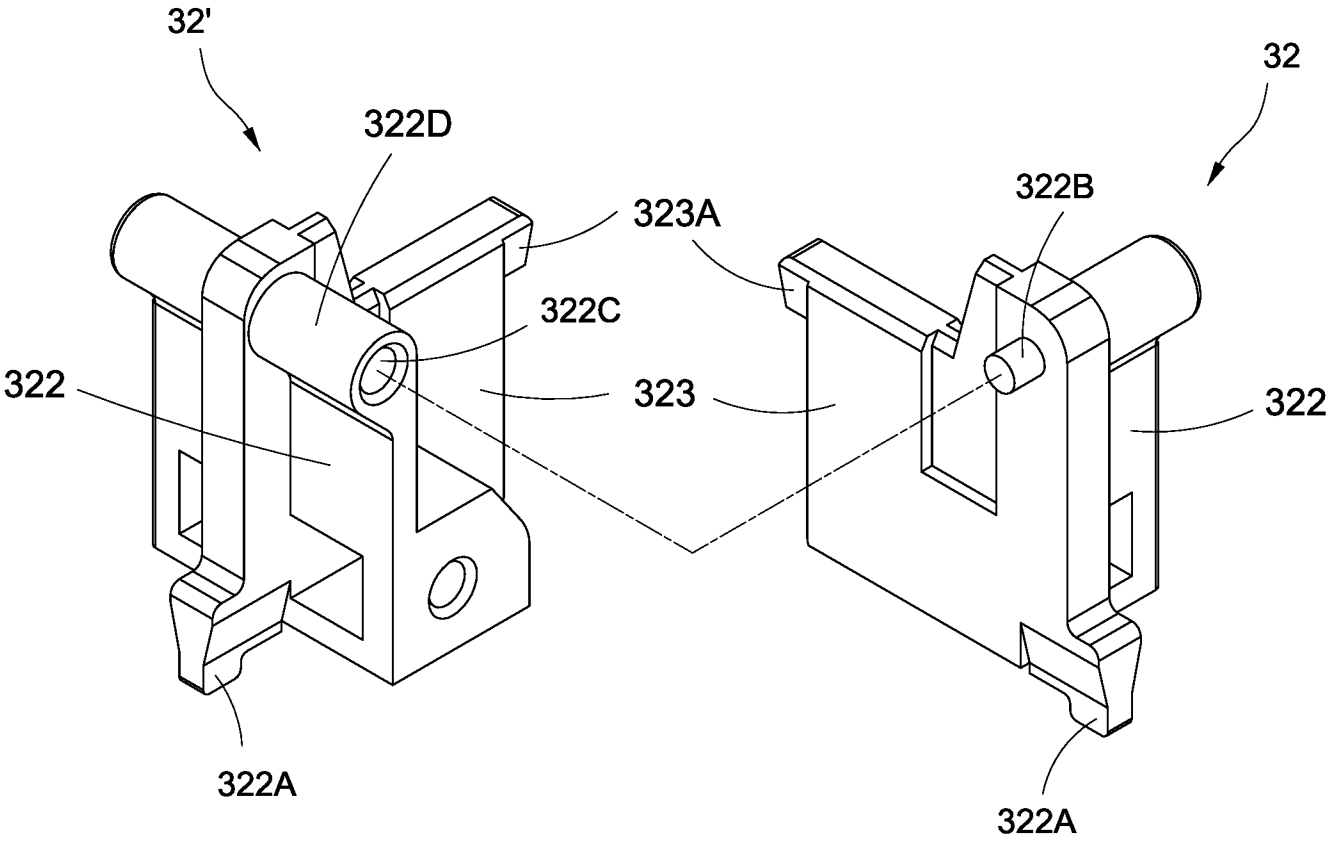
FIG. 8 is an exploded view of another embodiment of the insulative support of the disclosure.

Please refer to FIG. 8. Each of a left side and a right side of each transverse side plate 322 is formed with at least one connecting bar 322B and at least one connecting hole 322C. The connecting bar 322B of each transverse side plate 322 is fixedly embedded into the connecting hole 322C of adjacent transverse side plate 322 to connect the insulative supports 32 in series. Outer one of the insulative supports 32 is symmetrically formed as an insulative support 32'. The insulative support 32' is symmetrically extended with two transverse side plates 322 separately toward the left direction and the right direction, two support shafts 322D and two connecting holes 322C so as to install two flexible clamping sheets 33, but not limited to this, for example, each insulative support 32 may also be the same piece formed by plastic injection molding.

The flexible clamping sheet 33 is, but not limited to, a metal sheet with desirable conductivity. The flexible clamping sheet 33 includes a fixing section 331, a pressing section 332 and a surrounding section 333 connected between the fixing section 331 and the pressing section 332. Each flexible clamping sheet 33 is disposed on each insulative support 32. One end of each flexible clamping sheet 33 flexibly abuts against the first side wall 311 and the other end of each flexible clamping sheet 33 is located in each clamping space 321 and operatably clamps or releases each wire A. In detail, each transverse side plate 322 is transversely extended with a support shaft 322D. The surrounding section 333 is of an arc shape and surrounds the support shaft 322D so as to make a distal end of the fixing section 331 flexibly abut against the first side wall 311, and make a distal end of the pressing section 332 flexibly press the second side wall 312. As a result, each flexible clamping sheet 33 is fixed on the feed-side conductive plate 31. In some embodiments, the second side wall 312 is provided with multiple hooks 312C toward the first side wall 311 corresponding to each insulative support 32. Each hook 312C is engaged with each pressing section 332 of each flexible clamping sheet 33 to axially limit each pressing section 332 to make each pressing section 332 only downward sway to facilitate insertion and fixing of the wire A after engagement.

Furthermore, please refer to FIGS. 1, 2, 6 and 7. The feeder terminal block further includes multiple release sliders 50 corresponding to the number of the wire holes 12. Each release slider 50 is axial-slidably disposed on a side of corresponding one of the wire holes 12 and penetrates to reach in the chamber 11 to contact each flexible clamping sheet 33 to press each pressing section 332 so as to control the communication between each wire hole 12 and each clamping space 321. In detail, when each release slider 50 is downward pressed along the axial direction, each pressing section 332 of each flexible clamping sheet 33 is pressed downward to make each wire hole 12 and each clamping space 321 communicate with each other so as to facilitate insertion or withdrawal of each wire A. when each release slider 50 is released, each flexible clamping sheet 33 makes each pressing section 332 be re-engaged with each hook 312C by its own elasticity and push each release slider 50 to restore to the original position. In addition, the insulative case 10 further includes a side cover 14. The side cover 14 covers a side of the insulative case 10 to shield the supply-side conductive plate 20 and each wire connecting module 30.

While this disclosure has been described by means of specific embodiments, numerous modifications and variations could be made thereto by those skilled in the art without departing from the scope and spirit of this disclosure set forth in the claims.

What is claimed is:

1. A feeder terminal block for multiple wires to be inserted, the feeder terminal block comprising:

an insulative case, comprising a chamber and at least two wire holes communicating with the chamber;

a supply-side conductive plate, disposed in the chamber; and at least one wire connecting module, mounted on the supply-side conductive plate, and comprising a feed-side conductive plate, at least two insulative supports and at least two flexible clamping sheets, wherein the feed-side conductive plate is electrically connected to the supply-side conductive plate and comprises a first side wall and a second side wall opposite to each other, the insulative supports are arranged parallelly on the feed-side conductive plate, a clamping space is collectively defined by each insulative support and the second side wall corresponding to each wire hole, each flexible clamping sheet is disposed on each insulative support, one end of each flexible clamping sheet flexibly abuts against the first side wall, and another end of each flexible clamping sheet is located in the clamping space and configured to operatably clamp or release one of the wires.

2. The feeder terminal block of claim 1, wherein the insulative support is formed in one piece.

3. The feeder terminal block of claim 1, wherein the supply-side conductive plate comprises multiple riveting bars disposed protrusively, the feed-side conductive plate of the wire connecting module comprises multiple riveting holes, and each riveting hole is passed by and fixedly riveted with each riveting bar.

4. The feeder terminal block of claim 1, wherein each insulative support comprises a transverse side plate and a longitudinal side plate, the clamping space is collectively enclosed by the transverse side plate, the longitudinal side plate and the second side wall.

5. The feeder terminal block of claim 4, wherein the transverse side plate comprises a connecting bar and a connecting hole disposed on two sides thereof, and the connecting bar of the transverse side plate is fixed in the connecting hole of the transverse side plate adjacent to each other.

6. The feeder terminal block of claim 4, wherein multiple slots are respectively disposed on the first side wall and the second side wall corresponding to each insulative support, the longitudinal side plate comprises multiple blocks corresponding to the slots, and each block is correspondingly embedded in each slot.

7. The feeder terminal block of claim 6, wherein a protrusion is protrusively disposed in each slot, and the protrusion is fixed with one of the blocks correspondingly.

8. The feeder terminal block of claim 4, wherein each flexible clamping sheet comprises a fixing section, a pressing section and a surrounding section connected between the fixing section and the pressing section, each transverse side plate comprises a support shaft extended therefrom, and the surrounding section surrounds the support shaft to make the fixing section flexibly abut against the first side wall and the pressing section flexibly press the second side wall.

9. The feeder terminal block of claim 8, wherein the second side wall comprises multiple hooks disposed toward the first side wall corresponding to each insulative support, and each hook is engaged with each pressing section to axially limit each flexible clamping sheet.

10. The feeder terminal block of claim 9, further comprising: multiple release sliders, each release slider is slidably disposed on a side of each wire holes and configured to press each pressing section to control communication between each wire hole and each clamping space.

* * * * *